US006951406B2

(12) United States Patent
Becker

(10) Patent No.: US 6,951,406 B2
(45) Date of Patent: Oct. 4, 2005

(54) LED TASK LIGHT

(75) Inventor: Kent A. Becker, Huntertown, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/422,230

(22) Filed: Apr. 24, 2003

(65) Prior Publication Data

US 2004/0212990 A1 Oct. 28, 2004

(51) Int. Cl.[7] ..... A47B 23/06; F21V 23/04

(52) U.S. Cl. ..... 362/127; 362/249; 362/251; 362/800

(58) Field of Search ..... 362/33, 127, 133, 362/227, 234, 235–237, 240, 249, 251, 252, 800, 812; 361/638, 649, 721, 784; 345/39; 340/815.45; 40/544, 564, 570, 575, 576, 581

(56) References Cited

U.S. PATENT DOCUMENTS

| | | | | | |
|---|---|---|---|---|---|
| 4,521,835 | A | * | 6/1985 | Meggs et al. | 362/251 |
| 4,587,754 | A | * | 5/1986 | Ossner | 40/564 |
| 5,222,799 | A | | 6/1993 | Sears et al. | 362/146 |
| 5,408,395 | A | * | 4/1995 | Schmid et al. | 362/240 |
| 5,559,681 | A | * | 9/1996 | Duarte | 362/251 |
| 5,607,227 | A | | 3/1997 | Yasumoto et al. | 362/249 |
| 5,655,830 | A | * | 8/1997 | Ruskouski | 362/240 |
| 5,768,814 | A | * | 6/1998 | Kozek et al. | 40/570 |
| 5,796,331 | A | * | 8/1998 | Lamparter | 40/564 |
| 5,961,200 | A | | 10/1999 | Friis | 362/132 |
| 6,065,854 | A | * | 5/2000 | West et al. | 362/249 |
| 6,142,647 | A | | 11/2000 | Hayakawa | 362/230 |
| 6,152,590 | A | | 11/2000 | Fürst et al. | 362/545 |
| 6,161,910 | A | | 12/2000 | Reisenauer et al. | 316/309 |
| 6,167,648 | B1 | * | 1/2001 | Dimmick | 40/564 |
| 6,183,109 | B1 | | 2/2001 | Nelson et al. | 362/249 |
| 6,203,180 | B1 | | 3/2001 | Fleischmann | 362/471 |
| 6,288,497 | B1 | | 9/2001 | Chang et al. | 315/185 |
| 6,305,825 | B1 | | 10/2001 | Okubo | 362/294 |
| 6,314,669 | B1 | * | 11/2001 | Tucker | 340/815.45 |
| 6,371,637 | B1 | * | 4/2002 | Atchinson et al. | 362/249 |
| 6,508,566 | B1 | * | 1/2003 | Roorda | 362/133 |
| 2003/0193803 | A1 | * | 10/2003 | Lin | 362/250 |

* cited by examiner

*Primary Examiner*—Alan Cariaso
(74) *Attorney, Agent, or Firm*—Taylor & Aust, P.C.

(57) ABSTRACT

A task light for use in modular office furniture includes a housing having a peripheral frame defining a display area. The frame has a hollow chase. A plurality of circuit boards are mounted to the housing within the display area. Each circuit board has a plurality of light emitting diodes arranged to emit light from the display area. A plurality of electrical conductors are routed within the frame through the hollow chase. Each electrical conductor is connected with a corresponding circuit board.

11 Claims, 4 Drawing Sheets

LED TASK LIGHT

BACKGROUND OF THE INVENTION

1. Field of the Invention

The present invention relates to modular office furniture used in an office environment, and, more particularly, to task lights mounted under overhead storage bins on modular wall panels.

2. Description of the Related Art

Modular office furniture typically includes a plurality of modular wall panels which are coupled together in various orientations and configurations to define work spaces in an office environment. The modular wall panels are configured to connect with accessories, such as work surfaces, overhead storage bins, etc., so that each work space or cubical may be configured as desired. It is known to attach a task light to the bottom of an overhead storage bin for the purpose of illuminating the work surface. Such task lights typically use incandescent or fluorescent type lighting, which provides sufficient light output for adequately illuminating the work surface. However, incandescent and fluorescent task lights are relatively large and take up additional space in a cubical. For some cubicals, this space may not be available and thus use of an incandescent or fluorescent task light is not possible. Further, the large size and bulkiness of incandescent and fluorescent task lights may be aesthetically undesirable to some users. Additionally, incandescent and fluorescent task lights may utilize more electrical power than is desired when electrical power resources are limited.

What is needed in the art is a task light for use in an office environment which is aesthetically appealing, occupies relatively little space within the office environment, and utilizes very little electrical power.

SUMMARY OF THE INVENTION

The present invention provides a task light for use in an office environment, including a housing with a hollow frame which routes all necessary electrical conductors extending between a power cable and an array of white light LED's.

The invention comprises, in one form thereof, a task light for use in modular office furniture, including a housing having a peripheral frame defining a display area. The frame has a hollow chase. A plurality of circuit boards are mounted to the housing within the display area. Each circuit board has a plurality of light emitting diodes arranged to emit light from the display area. A plurality of electrical conductors are routed within the frame through the hollow chase. Each electrical conductor is connected with a corresponding circuit board.

An advantage of the present invention is that the LED task light has a housing configured to route all of the necessary electrical conductors from the power cable to the circuit boards.

Another advantage is that the open architecture of the housing allows the circuit boards to be connected in multiple configurations, including parallel and/or serial configurations.

Yet another advantage is that the LED task light may be quickly and easily installed under an overhead storage bin.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
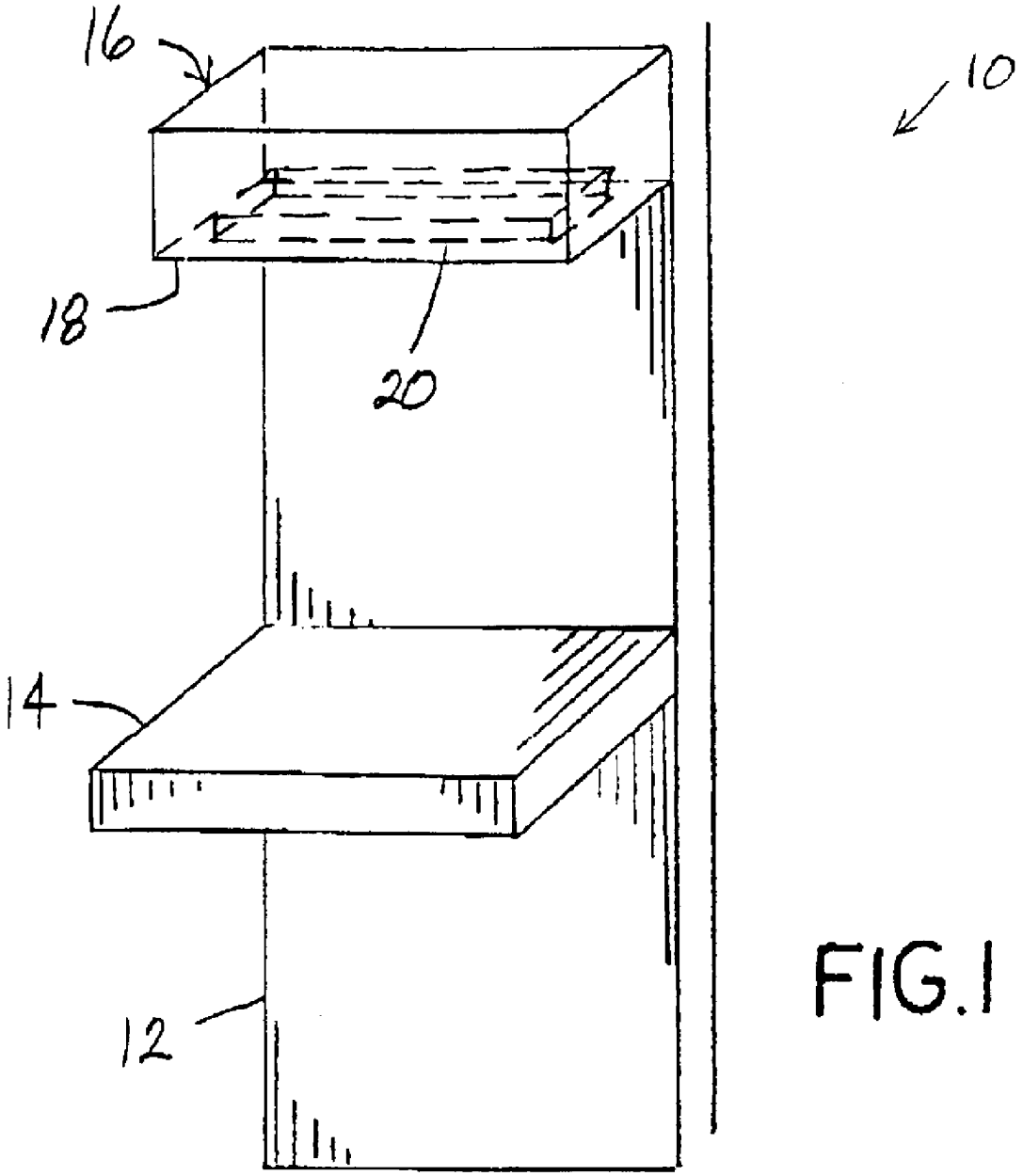
FIG. 1 is a perspective view of a modular office furniture assembly, including an embodiment of an LED task light of the present invention.

Referring now to the drawings, and more particularly to FIG. 1, there is shown an embodiment of a modular office furniture assembly 10, including modular wall panel 12 which is coupled with and carries a work surface 14 and overhead storage bin 16. Wall panel 12 includes longitudinally extending side edges which couple with other wall panels in various configurations to define work spaces or cubicals within an office environment. Overhead storage bin 16 has a front door (not specifically shown) which may be opened and closed for access to an internal storage cavity. Overhead storage bin 16 also includes a bottom surface 18 having a recess in which is mounted an LED task light 20, to be described in more detail hereinafter. LED task light 20 is configured to direct light in a downward direction toward work surface 14 to illuminate the upper surface of work surface 14, including any objects placed thereon.

Figure 2:
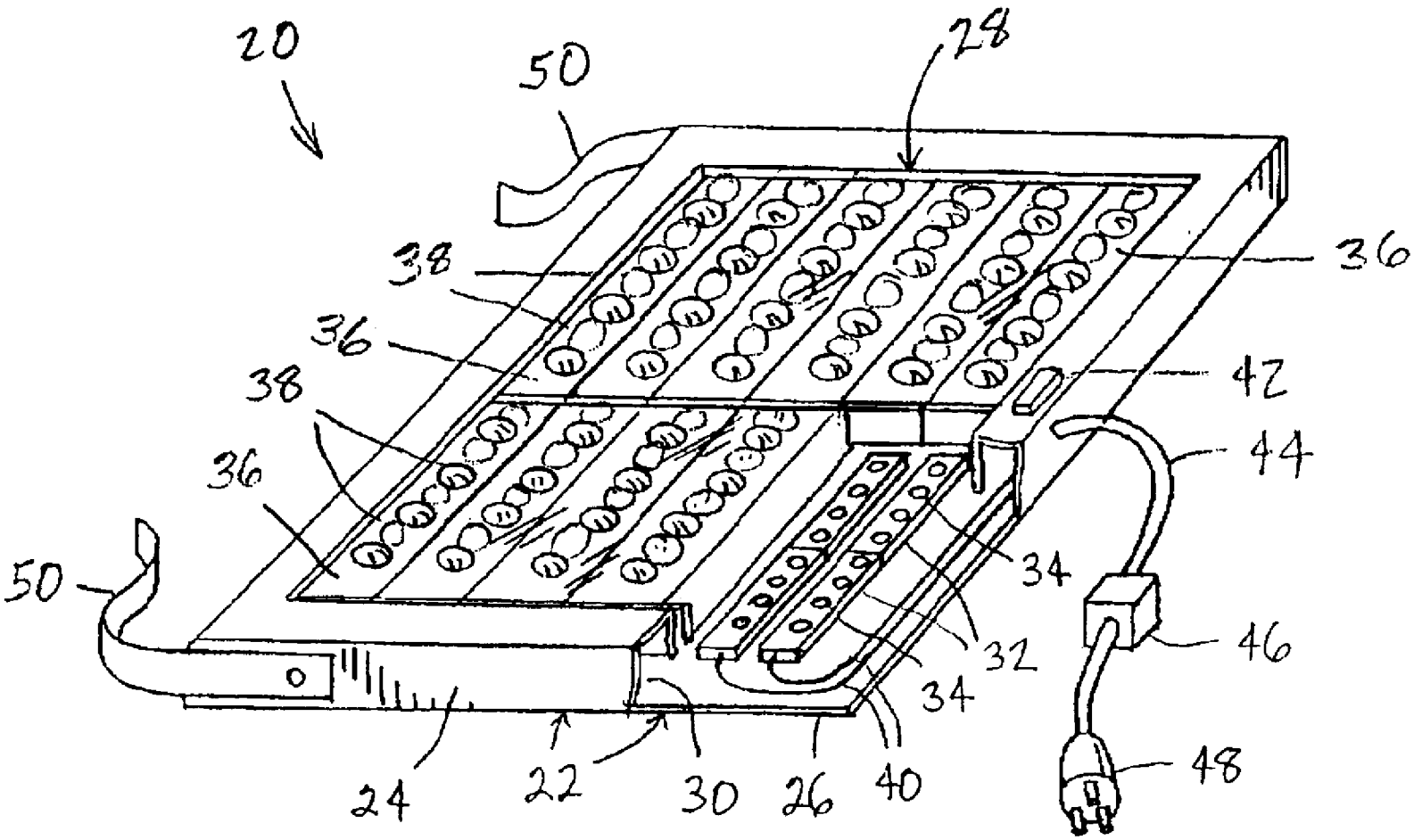
FIG. 2 is a perspective, fragmentary view of the LED task light shown in FIG. 1.

Referring now to FIG. 2, LED task light 20 is shown in greater detail. LED task light 20 includes a housing 22 having a frame 24 and back plate 26. Back plate 26 is sized such that LED task light 20 may be mounted within the recess in bottom surface 18 of overhead storage bin 16. Back plate 26 is formed of sheet metal in the embodiment shown, but may also be formed from plastic, wood, etc.

Frame 24 extends around the periphery of back plate 26 and defines a display area 28. In the embodiment shown, frame 24 has an overall generally rectangular shape corresponding to the rectangular shape of back plate 26. Frame 24 has a generally U-shaped cross section (as shown by the fragmentary cut-away portion in FIG. 2), with a closed end, a pair of legs extending from the closed end, and an open end positioned against back plate 26. In this manner, frame 26 defines a hollow chase 30 through which electrical conductors are routed for connection with the various electrical components.

A plurality of printed circuit boards 32 are mounted to back plate 26 within display area 28 defined by frame 24. Each printed circuit board 32 has a strip configuration, with electrical terminals (not specifically shown) coupled in a parallel manner with a plurality of LED's 34 formed integral with the circuit board. LED's 34 are preferably white light emitting diodes, but may emit differently colored light waves depending upon the application. Each LED 34 may be mounted to and electrically coupled with a corresponding printed circuit board 32 using surface mount technology, soldered pins, etc.

In the embodiment shown, each printed circuit board 32 carries four LED's 34. An example of such a circuit board is manufactured by Opto Semiconductors, part number PX 470.

A plurality of lenses 36 snap fit over printed circuit boards 32. Each lens 36 is configured to concentrate the light emitted from LED's 34 and direct the concentrated light toward work surface 14. For example, each lens 36 may include multiple optical concentrators 38 corresponding to one or more LED's 34 on printed circuit board 32. In the embodiment shown, each lens 36 is also manufactured by Opto Semiconductors to fit on a corresponding printed circuit board 32.

A plurality of electrical conductors 40 are routed within frame 24 through hollow chase 30 to electrically interconnect printed circuit boards 32 with switch 42 and power cable 44. Electrical conductors 40 may be in the form of single conductors, multi-conductor cables, etc., depending upon the application. Alternatively, electrical conductors 40 may be in the form of modular electrical connectors which plug directly onto an end of printed circuit boards 32. Electrical conductors 40 are electrically coupled with switch 42, which selectively applies electrical power to LED's 34. Switch 42 is in the form of a single pole slide switch in the embodiment shown, but may be differently configured.

Power cable 44 is coupled with an AC/DC converter 46, which in turn is coupled with a multi-prong plug 48. Multi-prong plug 48 receives conventional 115 volt AC power, and AC/DC converter 46 converts the AC power to a desired DC output voltage (e.g., 10 volts).

Spring clips 50 are attached to frame 24 of housing 22. Each spring clip 50 includes a free distal end which is biased to the position shown. Spring clips 50 maintain frame 24 within a groove formed in the recess at the bottom surface 18 of overhead storage bin 16.

Figure 3:
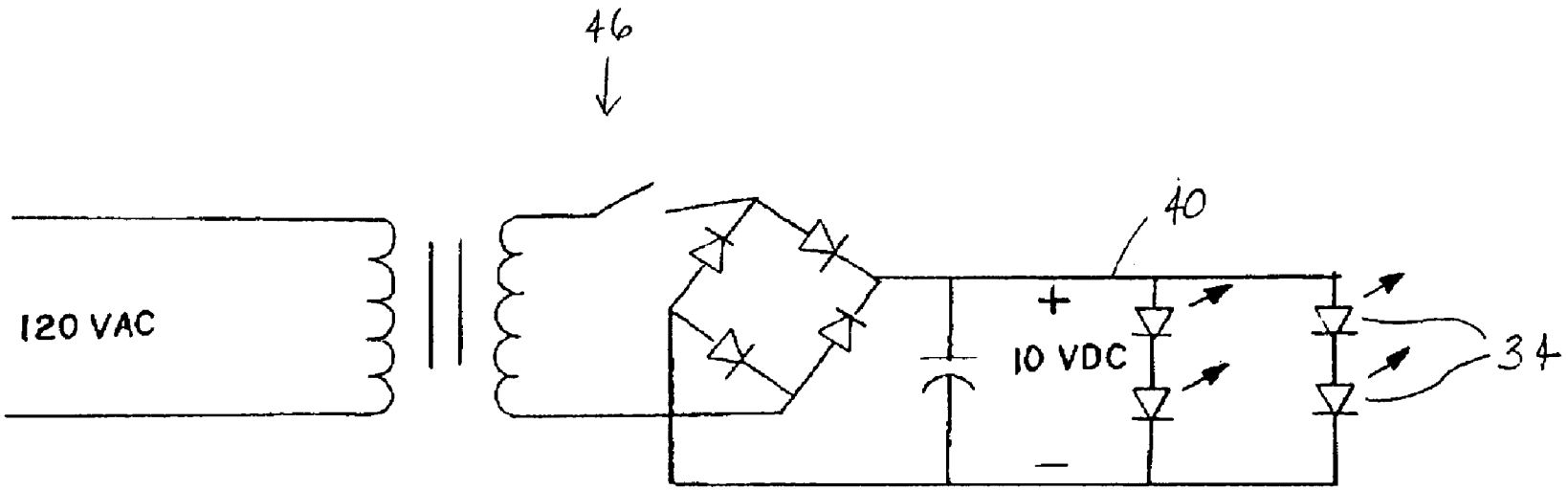
FIG. 3 is an electrical schematic of the LED task light shown in FIGS. 1 and 2.
Figure 4:
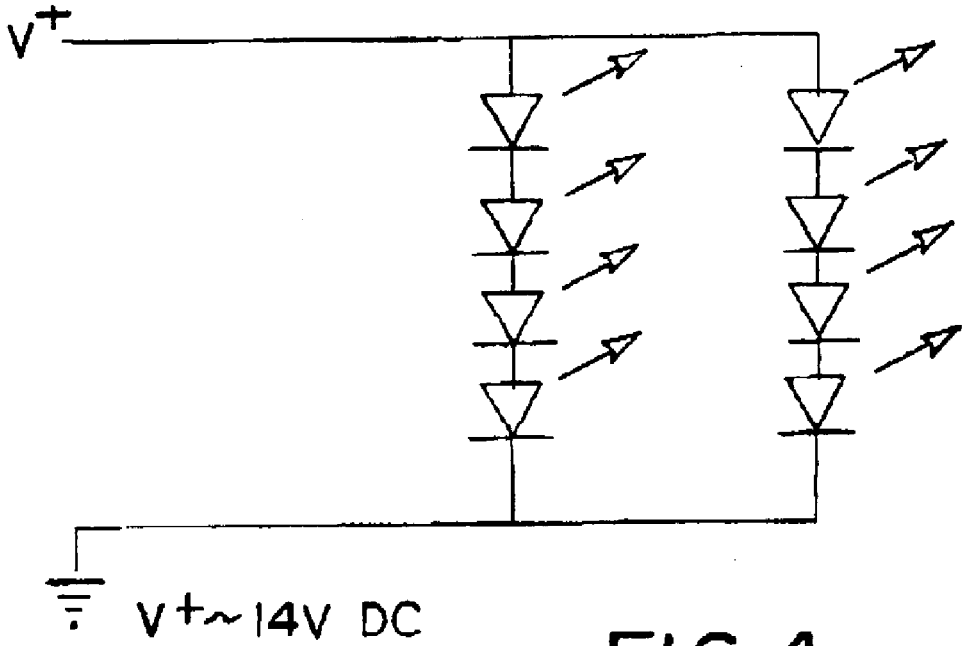
FIG. 4 is an electrical schematic of another embodiment of an LED task light of the present invention.
Figure 5:
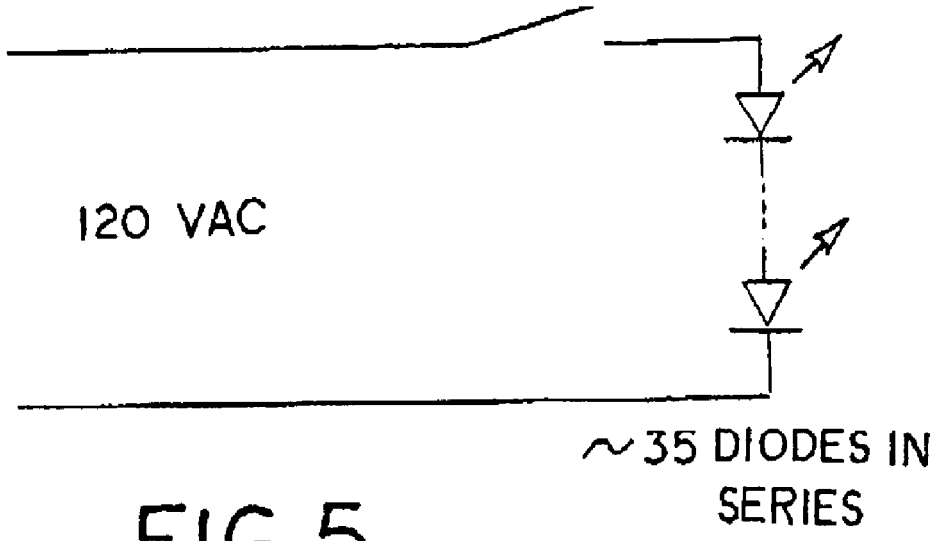
FIG. 5 is an electrical schematic of yet another embodiment of an LED task light of the present invention.

FIG. 3 illustrates an electrical schematic of LED task light 20 shown in FIGS. 1 and 2. FIGS. 4 and 5 illustrate other possible electrical schematic arrangements for use with LED task light 20. Of course, other electrical schematic arrangements are also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A task light for use in modular office furniture, comprising:

a housing having a peripheral frame defining a display area, said frame having a hollow chase, said housing including a back plate, said frame having a generally U-shaped cross section with an open end, said open end being positioned against said back plate;

a plurality of circuit boards, mounted to said housing within said display area, each said circuit board having a plurality of light emitting diodes arranged to emit light from said display area, said plurality of circuit boards arranged in plurality of rows, each said row including a plurality of said circuit boards; and a plurality of electrical conductors routed within said frame through said hollow chase, each said electrical conductor connected with a corresponding said circuit board.

2. The task light of claim 1, said frame having a generally rectangular shape and lying about a periphery of said back plate.

3. The task light of claim 2, including a power cable connected with said frame, said plurality of electrical conductors being electrically connected with said power cable.

4. A modular office furniture assembly, comprising:

a modular wall panel;

an overhead storage bin mounted to said wail panel; and a task light mounted under said storage bin, said task light including:

a housing having a peripheral frame defining a display area, said frame having a hollow chase;

a plurality of circuit boards mounted to said housing within said display area, each said circuit board having a plurality of light emitting diodes arranged to emit light from said display area; and a plurality of electrical conductors routed within said frame through said hollow chase, each maid electrical conductor connected with a corresponding said circuit board.

5. The modular office furniture assembly of claim 4, said housing including a back plate, said frame having a generally U-shaped cross section with an open end, said open end being positioned against said back plate.

6. The modular office furniture assembly of claim 4, said frame having a generally rectangular shape and lying about a periphery of said back plate.

7. The modular office furniture assembly of claim 6, including a power cable connected with said frame, said plurality of electrical conductors being electrically connected with said power cable.

8. The module office furniture assembly of claim 4, each said light emitting diode being a white light emitting diode.

9. The modular office furniture assembly of claim 4, including a switch electrically coupled with a power cable and said plurality of electrical conductors.

10. The modular office furniture assembly of claim 4, said plurality of circuit boards arranged in an array.

11. The modular office furniture assembly of claim 4, including a pair of spring clips attached to and extending from said housing, each said spring clip engaged with said overhead storage bin.

* * * * *

UNITED STATES PATENT AND TRADEMARK OFFICE

CERTIFICATE OF CORRECTION

PATENT NO. : 6,951,406 B2
DATED : October 4, 2005
INVENTOR(S) : Becker

It is certified that error appears in the above-identified patent and that said Letters Patent is hereby corrected as shown below:

Column 4,
Line 4, delete "boards," and substitute -- boards --;
Line 24, delete "wail" and substitute -- wall --;
Line 34, delete "maid" and substitute -- said --; and
Line 48, delete "module" and substitute -- modular --.

Signed and Sealed this

Eleventh Day of April, 2006

JON W. DUDAS
*Director of the United States Patent and Trademark Office*